US006917346B2

(12) United States Patent
Izzat et al.

(10) Patent No.: US 6,917,346 B2
(45) Date of Patent: Jul. 12, 2005

(54) WIDE BANDWIDTH BASE STATION ANTENNA AND ANTENNA ARRAY

(75) Inventors: Narian K. Izzat, Frankfort, IL (US); Warren Frederick Hunt, Farmington, CT (US); Kevin E. Linehan, Justice, IL (US)

(73) Assignee: Andrew Corporation, Orland Park, IL (US)

( * ) Notice: Subject to any disclaimer, the term of this patent is extended or adjusted under 35 U.S.C. 154(b) by 1 day.

(21) Appl. No.: 10/343,565

(22) PCT Filed: Sep. 6, 2002

(86) PCT No.: PCT/US02/28275

§ 371 (c)(1),
(2), (4) Date: May 31, 2003

(87) PCT Pub. No.: WO03/023901

PCT Pub. Date: Mar. 20, 2003

(65) Prior Publication Data

US 2004/0201541 A1 Oct. 14, 2004

Related U.S. Application Data

(60) Provisional application No. 60/403,198, filed on Aug. 13, 2002, and provisional application No. 60/318,008, filed on Sep. 7, 2001.

(51) Int. Cl.[7] ..... H01Q 1/36

(52) U.S. Cl. ..... 343/895; 343/700 MS

(58) Field of Search ..... 343/895, 700 MS, 343/702, 795, 792.5, 850, 853

(56) References Cited

U.S. PATENT DOCUMENTS

| | | | | |
|---|---|---|---|---|
| 3,013,268 A | | 12/1961 | Du Hamel et al. | 343/792.5 |
| 4,243,993 A | | 1/1981 | Lamberty et al. | 343/895 |
| 4,286,271 A | | 8/1981 | Barbano et al. | 343/772.5 |
| 4,490,725 A | | 12/1984 | Kuo | 343/792.5 |
| 4,658,262 A | | 4/1987 | DuHamel | 343/792.5 |
| 4,945,363 A | | 7/1990 | Hoffman | 343/895 |
| 5,668,559 A | | 9/1997 | Baro | 343/702 |
| 5,812,943 A | | 9/1998 | Suzuki et al. | 455/333 |
| 5,945,951 A | | 8/1999 | Monte et al. | 343/700 MS |
| 5,952,983 A | | 9/1999 | Dearnley et al. | 343/817 |
| 5,986,609 A | * | 11/1999 | Spall | 343/702 |
| 6,018,323 A | | 1/2000 | Van Hoozen et al. | 343/792.5 |
| 6,018,327 A | | 1/2000 | Nakano et al. | 343/895 |
| 6,028,567 A | | 2/2000 | Lahti | 343/895 |
| 6,034,649 A | | 3/2000 | Wilson et al. | 343/795 |
| 6,072,439 A | | 6/2000 | Ippolito et al. | 343/797 |
| 6,094,179 A | | 7/2000 | Davidson | 343/895 |
| 6,255,999 B1 | | 7/2001 | Faulkner et al. | 343/895 |
| 6,337,670 B1 | | 1/2002 | Chen | 343/895 |
| 2001/0045915 A1 | | 11/2001 | Moren | |

OTHER PUBLICATIONS

Supplementary European Search Report; Application No. EP 02 78 0270.

United States Statutory Invention Registration of Davis, Reg. No. H1460, Published Jul. 4, 1995.

PCT International Search Report for International Application No. PCT/US02/28275.

* cited by examiner

*Primary Examiner*—Hoang V. Nguyen
(74) *Attorney, Agent, or Firm*—Welsh & Katz, Ltd.

(57) ABSTRACT

A base station antenna array comprises a ground plane and a parallel array of antennas above the ground plane. The antennas each have a progression of radiating elements whose length increases in a direction away from the ground plane. A feed is connected to the antenna at a point nearest the ground plane.

59 Claims, 5 Drawing Sheets

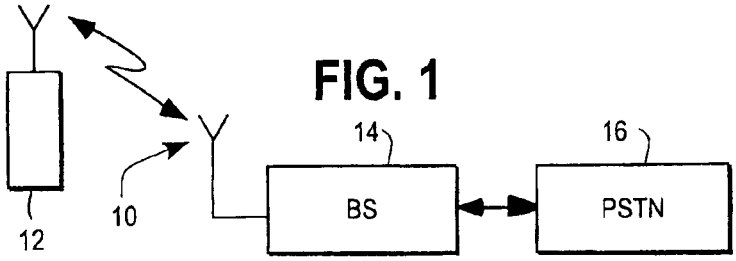
FIG. 1
FIG. 2
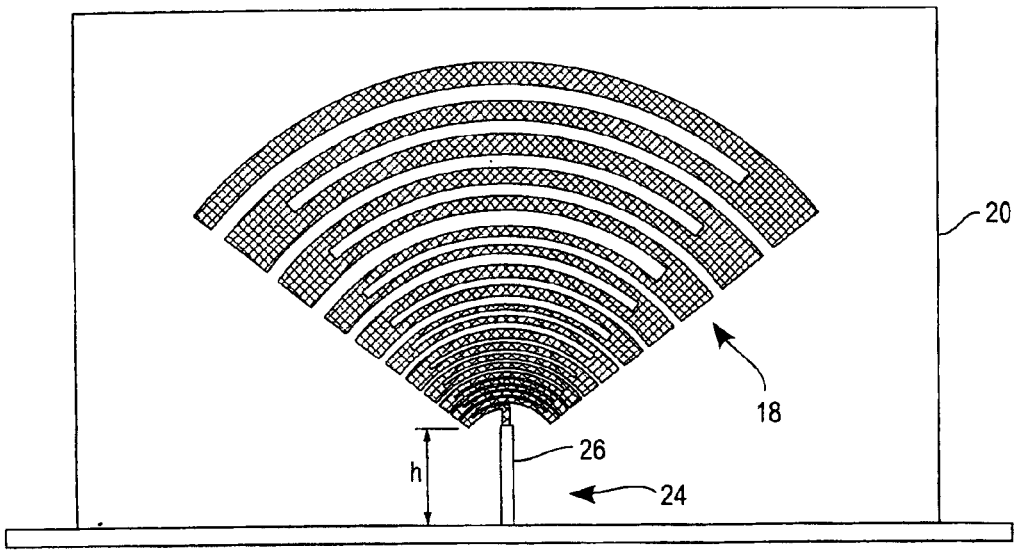
FIG. 3
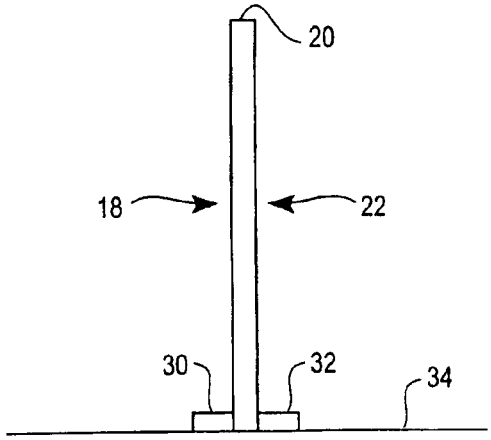

WIDE BANDWIDTH BASE STATION ANTENNA AND ANTENNA ARRAY

CROSS REFERENCE TO RELATED APPLICATIONS

This application claims the benefit of priority from U.S. Provisional Patent Application Ser. No. 60/318,008 filed on Sep. 7, 2001, entitled Wide-Band Base Station Antenna And Antenna Array, and from U.S. Provisional Patent Application Ser. No. 60/403,198, filed on Aug. 13, 2002, entitled Ultra Wide-Band Radiating Element For Cellular Wireless Applications. Provisional patent application Ser. Nos. 60/318,008 and 60/403,198 are incorporated herein by reference in their entirety.

FIELD OF THE INVENTION

The field of the invention relates to cellular base stations and more particularly to antennas and antenna arrays for cellular base stations and microcellular/wireless applications.

BACKGROUND OF THE INVENTION

Cellular systems are generally known. Typically, a geographic area of a cellular system is divided into a number of overlapping areas (cells) that may be serviced from nearby base stations. The base stations may be provided with a number of directional antenna that preferentially transceive signals with mobile cellular devices within each assigned cell.

Cellular systems are typically provided with a limited radio spectrum for servicing mobile cellular devices. Often a frequency reuse plan is implemented to minimize interference and maximize the efficiency of channel reuse.

An important factor in channel reuse is the presence of a base station antenna that radiate and receive in predictable patterns. Often base station antenna divide the area around the base station into 60 degree sectors extending outwards from the base station.

While existing systems function adequately, the increasing use of cellular devices has exacerbated the need for channel reuse in even smaller geographic areas. Further, the release of additional spectrum (e.g., for PCS) has resulted in the need for cellular antenna with a greater range of use. Because of the importance of cellular devices, a need exists for an antenna with a greater spectral range of use and smaller size.

BRIEF DESCRIPTION OF THE DRAWINGS

FIG. 1 is a block diagram of an antenna shown in accordance with an illustrated embodiment of the invention;

FIGS. 2–4 are detailed front, side and rear views, respectively, of the antenna of FIG. 1;

DETAILED DESCRIPTION

Figure 4:
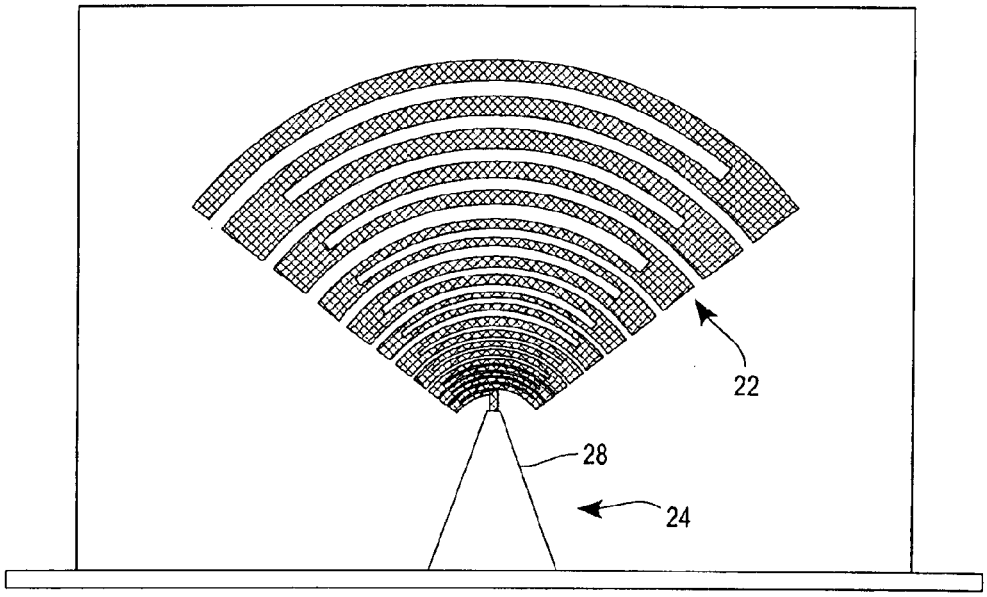

FIG. 1 is a block diagram of a broadband antenna 10, shown generally, in a context of use. As shown, the antenna

10 may be used to transceive a signal with a cellular device 12. The transceived signal, in turn, may be processed by a base station 14 and exchanged with another party (not shown) through the public switched telephone network 16.

The cellular device 12 may be any of a number of available cellular products (e.g., cellular telephone, PCS telephone, pager, palm pilot, etc.). The cellular system of FIG. 1 may be constructed to operate within any appropriate frequency range (e.g., 860–2170 MHz.).

FIGS. 2–4 are front, side and rear views, respectively, of the antenna 10 of FIG. 1. Under the illustrated embodiment, the antenna 10 may be provided as a flat assembly disposed over a metallic reflector or ground plane 34. The reflector 34 may have a corner or sidewalls.

The antenna 10 may be designed as a two arm radiating structure above ground. The antenna 10 may be vertically polarized with wide azimuth beam width and an input VSWR of 2:1.

The antenna 10 may include first and second arms (subassemblies) 18, 22 disposed on opposing sides of a substrate 20. The antenna arms 18, 22 may be substantially identical except that if a viewer were able to peer through the arm and substrate from a first side, the arm on the rear side would appear to be a left-to-right mirror image of the element on the first side.

The arms 18, 22 may be formed of an appropriate conductive material (e.g., copper) by a photolithographic process on an appropriate substrate (e.g., Taconic RF30–60). As such, each arm 18, 22 has the appearance of a flat, fan-shaped body disposed on the substrate 20 and defined by a sinuous conductor following a continuous serpentine path between opposing rays of the fan-shape from an apex end to a distal end of the fan-shaped body. The substrate 20 may be rectangular (as shown in FIG. 2) or may have a generally fan-shaped outline that follows the outside edges of the arms 18, 22.

The antenna arms 18, 22 may be connected to a radio frequency transceiver (not shown) in the base station 14 through a balun transformer 24 and microstrip lines 30, 32. The balun transformer 24 may consist of two elements 26, 28. The first element 28 may consist of a triangular shaped conductor, as shown in FIG. 4 where an apex of the triangle connects to the antenna arm 22 and a base of the triangle connects to the microstrip 32. A second element 26 may be a constant width conductor strip that connects to the antenna arm 18 on a first end and to the microstrip 30 on an opposing end. The balun transformer functions to transform the balanced impedance (e.g., 100–150 Ω) of the antenna arms 18, 22 to the unbalanced impedance (e.g., 50 Ω) of the microstrip lines 30, 32.

Each arm 18, 22 (FIG. 5) of the antenna 10 may be constructed as an assembly of radiating elements 22. The elements may be arranged as individual half-wavelength elements above ground. The largest, lowest frequency element may be arranged farthest away from the ground plane with the smaller higher frequency elements closer to the ground plane. The dimensions and aspect angles of the antenna 10 may be chosen in order to achieve constant and frequency-independent performance in the desired spectrum.

The arms 18, 22 of the antenna 10 may include a substantially fan or pie-shaped outline defined by opposing edges (or rays) 36, 38 extending upwards and outwards from the bottom. The rays of the fan-shaped substrate may merge at the bottom to form an apex 40.

Disposed on the substrate 20 may be a number of antenna elements 42 with a predetermined width and separation that may extend between the first and second edges 36, 38 of the substantially fan-shaped arms 18, 22, which extend radially outward away from the apex 40. The antenna elements 42 form a progression of progressively longer elements from bottom to top.

Figure 5:
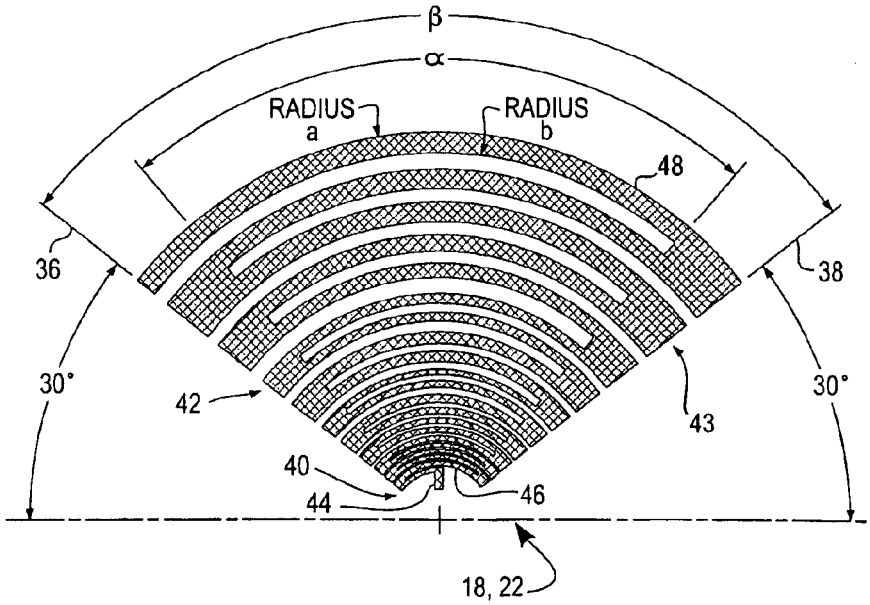
FIGS. 5–5*a* show details of the antenna of FIGS. 2–4.

The elements are preferably connected on opposing ends (e.g., on the left side to the element below and on the right side to the element above as shown in FIGS. 2, 4 and 5 by a rectangular end-connector (e.g., 43) to form a continuous conductor following a serpentine path extending from the apex 40 of the fan-shaped arm 18, 22 to a distal, top end of the arm 18, 22. A feedpoint 44 may be provided to couple the arms 18, 22 to the balun transformer 24.

The overall structure, including the feed mechanism and elements 42, may be realized by forming a fan-shaped sector of annular spaced elements 42 and connecting their ends with the end connectors 43, as shown in FIG. 5. Stated in another way, to form each arm 18, 22, the radial arcs 42 of each sector angle β may be created and joined together at alternate ends to form a closed solid conductor shape. This gives rise to a radially expanding zig-zag shape with an inner intersection sector angle of α. The radii of adjacent arcs can be related to each other by a constant t=a/b or by a constant linear relationship a−b=c.

Figure 5A:
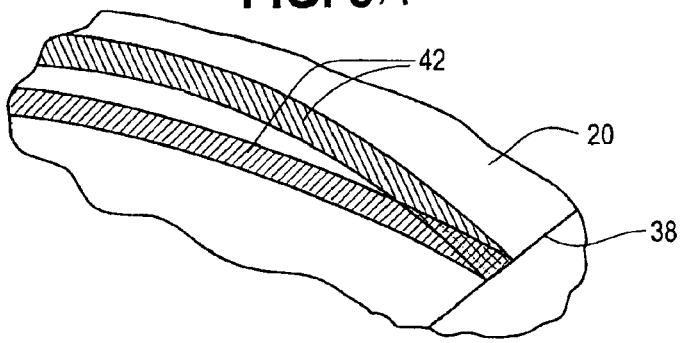

Alternatively, the rectangular end-connectors 43 may be eliminated by rotating alternating elements 42 in opposite directions to overlap on alternate ends (e.g., on the left side to the element below and on the right side to the element above) as shown, for example, in FIG. 5*a*. In this case, the overall structure may be formed by inverting and over laying angular sections of an n-turn spiral structure. The spiral structure may be linear or log-periodic. The width of lines, scale factor of the spiral structure and angles of inverted sections may all be chosen to optimize the electrically required operating parameters including return loss and azimuth beamwidth and frequency independent operation.

The actual shape of the elements 42 may approximate a folded linear spiral or helix. The folded spiral may be assumed to be folded about the center axis of rotation of the spiral and have truncated ends that have been vertically moved together to form connections with the element above and below.

The individual elements 42 each form a one-half wavelength resonator within a particular operating range of the antenna 10. For a frequency range, for example, from 860 MHz to 2.2 GHz, the antenna 10 may be 10 cm wide, the balun transformer 24 may have a height h of 3.5 cm, a may be 33 degrees and β may be 120 degrees. The radius of the outer most arc may be 6 cm.

The antenna 10 may be thought of as being formed of a number of series-connected one-half wavelength resonators. For example, a first element 46 may resonate at a relatively high frequency (e.g., 2.2 Hz.) while a second longer element 48 may resonate at a relatively low frequency (e.g., 860 MHz.). The elements lying in between the first and second elements 46., 48 may each resonate within some spectral range between 860 and 2.2 GHz.

In order to increase a bandwidth (reduce the Q) of each resonant element 42, an opposing end of each element 42 has been rotated up from the ground plane 34 (i.e., the elements 42 have been shortened) by an appropriate angular distance (e.g., 30 degrees) before being connected to the adjacent element. Further, by maintaining a constant height to length ratio among the antenna elements 42, a constant Q is provided across all the antenna elements 42. The length in this case being the arc length of one element 42 lying between the two opposing rays 36, 38. The height h is the stance of the center of the element 42 above the ground plane 26.

Figure 6:
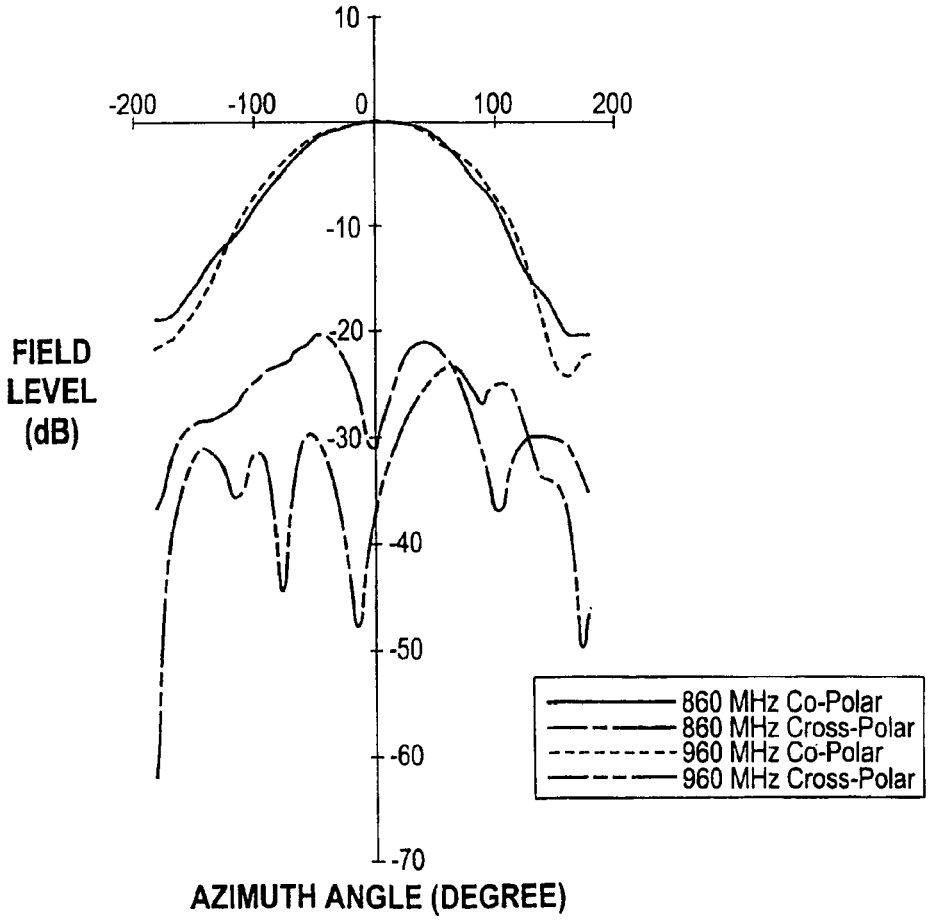
FIG. 6 depicts co- and cross-polar patterns in the frequency band of from 860–960 MHz for the antenna of FIG. 1.
Figure 7:
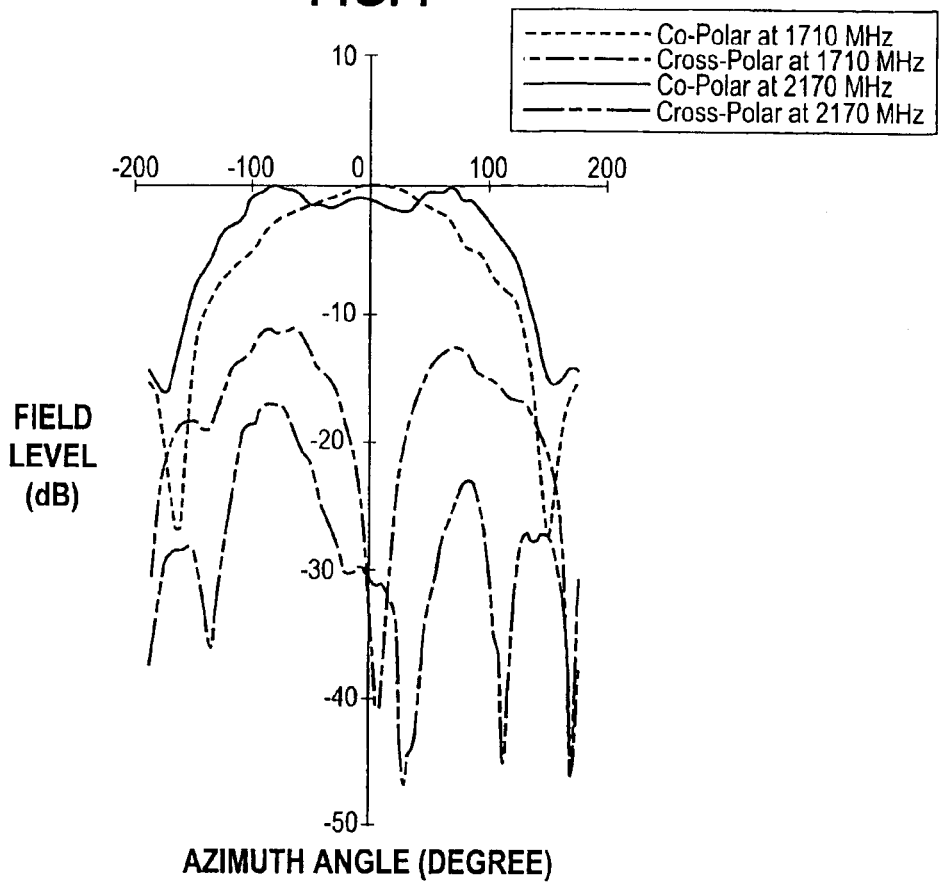
FIG. 7 depicts co- and cross-polar patterns in the frequency band of from 1710–2170 MHz for the antenna of FIG. 1.

While any number of antenna elements 42 may be used, it has been found that within the frequency range of interest (e.g., 860–2.2 GHz), twenty elements 42 provide a relatively constant response over a frequency range of interest. FIG. 6 depicts co- and cross-polar patterns of the antenna 10 in the frequency band of from 860 to 960 MHz. FIG. 7 depicts co- and cross-polar patterns of the antenna 10 in the frequency band of from 1710 to 2170 MHz.

The 3 dB beamwidths of the antenna 10 may be computed from the data of FIGS. 6 and 7. The computed 3 dB beamwides are shown in Table I.

TABLE I

| FREQUENCY (MHz) | AZIMUTH BEAM WIDTH (DEGREES) |
|---|---|
| 860 | 135 |
| 960 | 145 |
| 1710 | 150 |
| 2040 | 230 |
| 2170 | 225 |

It should be noted that while a constant beam width is measured in the lower operating frequency range, dispersion in azimuth beam width is recorded towards the upper end of the frequency band. This may be corrected by varying the height, h, of the arms 18, 22 above ground or by introducing side-walls in the reflector geometry in order to influence beam width in the higher frequency band of operation.

The geometry of FIGS. 2–4 was also modeled using electromagnetic modeling tools to determine the azimuth beam. The results are shown in Table II. The return loss was determined to be better than 10 dB.

TABLE II

| FREQUENCY (MHz) | AZIMUTH BEAM WIDTH (DEGREES) |
|---|---|
| 860 | 170 |
| 960 | 171 |
| 1710 | 205 |
| 2040 | 210 |
| 2170 | 210 |

The directive gain was computed for the antenna 10 based upon the computed patterns. The directive gain is shown in Table III.

TABLE III

| FREQUENCY (MHz) | DIRECTIVITY |
|---|---|
| 860 | 5.5 |
| 960 | 5.4 |
| 1710 | 4.67 |
| 2040 | 4.43 |
| 2170 | 4.46 |

Comparing directive gain from model results of table III measured gain of the actual antenna 10, it can be seen in general that measured gain is some 1.0 to 1.1 dB below directive gain. This is consistent with the overall loss budget of the antenna when an input reflection of −10 dB and loss in the microstrip feed line section 30, 32 is considered.

As may be noted from FIG. 6, the antenna 10 has a characteristic impedance of from 100–150 ohms. To match the antenna 10 to a 50 ohm cable, an impedance transformer may be used. The impedance transformer may be provided in the form of the balun transformer 24 discussed above.

From a performance point of view, it has been found that the antenna 10 has an azimuth beamwidth of 120 degrees. Where sidewalls are used in conjunction with the reflector 34, the angle of the corner and dimension of sidewalls may be optimized in order to achieve an azimuth beamwidth of 120 degrees.

Figure 8:
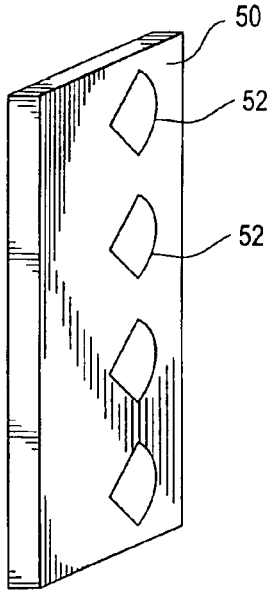
FIGS. 8–14 illustrate the antenna of FIGS. 2–5 under alternative embodiments of the invention in the context of a base station antenna array.

In the FIG. 8 antenna array 50, a plurality of antennas 52 are arranged in a linear geometry with the plane of each of the antennas 52 coplanar and vertical to produce vertically polarization radiation (assuming a typical vertical orientation of the array 50). In an alternative base station antenna array 54 shown in FIG. 9, the antennas 56 are oriented horizontally to produce horizontally polarized radiation.

Figure 9:
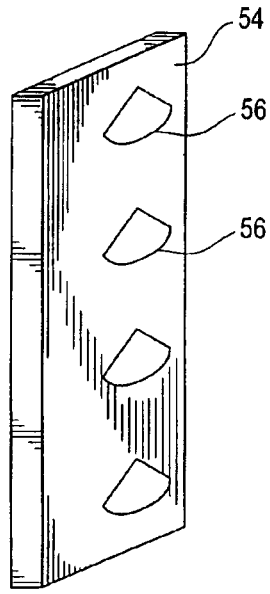
Figure 10:
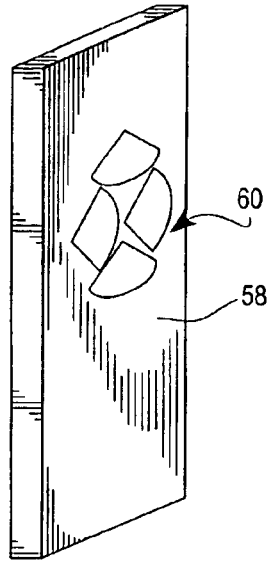

In yet another embodiment of the invention (FIG. 10), the antennas are arranged along the antenna array 58 in groups of four. In a preferred geometry the antennas are grouped in a box geometry as shown at 60. Box geometries in general are known in base station antennas. In the box geometry the individual antennas are oriented either parallel or orthogonal to a longitudinal axis of the antenna array, as shown in FIG. 9, or alternatively may be oriented at 45 degrees to a longitudinal axis of the antenna array (not shown).

Figure 11:
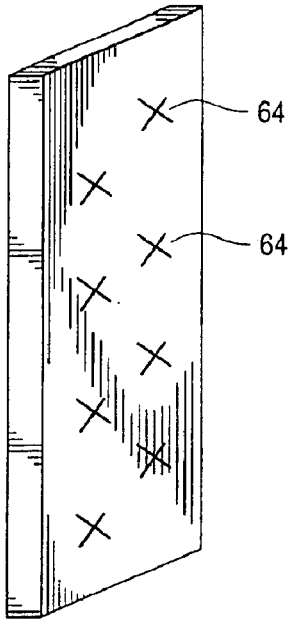

FIG. 11 is intended to show in highly schematic fashion that any of the antennas or antenna groups of the present invention may be arranged in a staggered, rather than in-line geometry.

As alluded to above, the present invention advantageously practices what is known as "self similarity", meaning that in preferred executions, the elements (42 in FIG. 5) which are farthest from the ground plane resonate at the lowest frequencies in the design frequency band. Elements resonating at higher frequencies are progressively shorter and closer to the ground plane 34, and have progressively smaller average spacings and progressively narrower conductor widths. This makes possible a very wideband, yet extremely compact, antenna structure.

Figure 12:
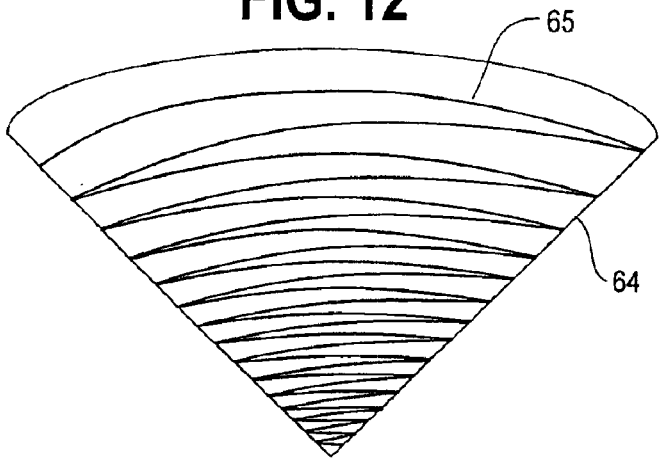
Figure 13:
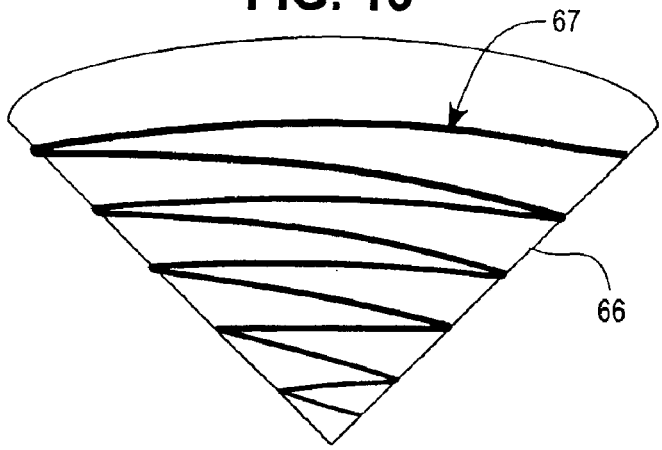

FIG. 12 depicts an antenna 66 in which the average spacing of the antenna elements 67 progressively decreases in a direction toward the ground plane. FIG. 13 depicts in highly schematic fashion an antenna 64 in which the conducting antenna elements are progressively narrower in width in a direction toward the ground plane 26.

Figure 14:
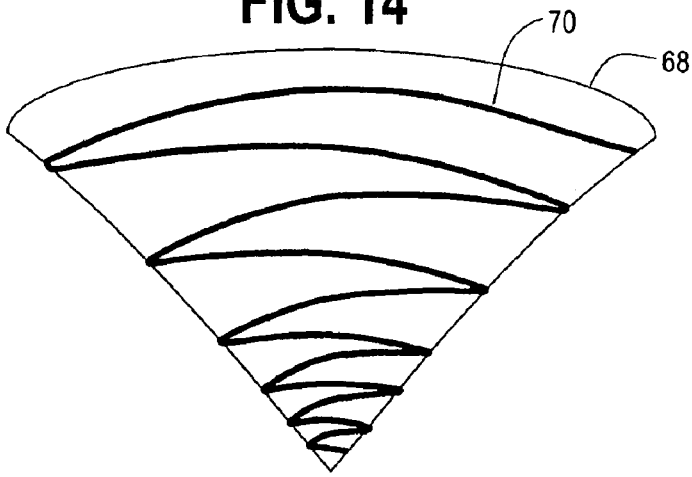

FIG. 14 illustrates an antenna 68 whose elements 70 embody simultaneously progressively decreasing: 1)line width, 2)average line spacing, 3)element length, and 4) spacing above the ground plane, thus uniquely availing the known benefits of self similarity in antenna design.

The FIG. 14 embodiment depicts exploitation of yet another variable available to designers employing the principles of the present invention—namely, the function governing the change in length of the antenna elements 70. In FIG. 5, the aspect angle of the antenna is fixed at a predetermined angle. That is, the variation in length of the antenna elements is linear. However, the variation in length may be exponential or may follow a variety of other nonlinear functions, as shown in FIG. 14.

The various executions of the invention described may be employed in single and dual polarization geometries as is well within the skill of the art.

Various embodiments of the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. An antenna assembly comprising:

a vertically oriented monopole antenna having a flat, fan-shaped body defined by a sinuous conductor following a continuous serpentine path in the vertical direction between opposing rays of the fan-shape from an apex end proximate a ground plane to a distal end of the fan-shaped body; and a feedpoint coupled to the sinuous conductor on the apex end of the antenna element.

2. The antenna assembly as in claim 1 further comprising a substrate supporting the antenna.

3. The antenna assembly as in claim 2 wherein the substrate further comprises the flat, fan-shaped body disposed on each side of the substrate.

4. The antenna assembly as in claim 3 wherein the fan-shaped body feedpoint further comprises a balun transformer.

5. The antenna assembly as in claim 1 wherein the serpentine path further comprises a plurality of straight, generally parallel radiating elements disposed between the rays of the fan-shaped body.

6. The antenna assembly as in claim 1 wherein the serpentine path further comprises a plurality of curved elements disposed between the rays of the fan-shaped body.

7. The antenna assembly as in claim 1 wherein the serpentine path further comprises a folded linear spiral.

8. The antenna assembly as in claim 1 further comprising a linear array of flat fan-shaped antennas.

9. The antenna assembly as in claim 8 further comprising a dual polarized connection to the linear array of flat fan-shaped antennas.

10. The antenna assembly as in claim 1 further comprising a planar array of flat fan-shaped antennas.

11. The antenna assembly as in claim 10 further comprising a dual polarized connection with the array of flat fan-shaped antennas.

12. A flat monopole antenna comprising;

a feedpoint;

a progression of progressively longer antenna elements of the flat monopole antenna each disposed between a pair of rays extending outwards from the feedpoint, wherein each progressively longer antenna element is connected on a first end to a corresponding end of an immediately previous antenna element of the progression and a second end to a corresponding end of an immediately successive element in the progression.

13. The flat monopole antenna as in claim 12 further comprising a substrate supporting the progression of antenna elements.

14. The flat monopole antenna as in claim 12 wherein the progressively longer antenna elements have a straight configuration.

15. The flat monopole antenna as in claim 12 wherein the progressively longer antenna elements have an arcuate configuration.

16. The flat monopole antenna as in claim 12 wherein the pair of rays further comprise an angle of less than one-hundred eighty degrees.

17. The flat monopole antenna as in claim 12 wherein the pair of rays further comprise an angle of about one-hundred degrees.

18. A flat monopole antenna comprising:

a flat pie-shaped substrate having a pair of edges defining an apex of the pie-shaped substrate; and a plurality of antenna elements disposed between the opposing edges of the pie-shaped substrate, each antenna element of the plurality of antenna elements joined at a first end to another antenna element of the plurality of antenna elements closer to the apex and joined at a second end to another antenna element of the plurality of elements further from the apex.

19. The flat monopole antenna as in claim 18 wherein wherein the plurality of antenna elements have a straight configuration.

20. The flat monopole antenna as in claim 18 wherein wherein the plurality of antenna elements have an arcuate configuration.

21. The flat monopole antenna as in claim 18 wherein the plurality of antenna elements further have a relatively constant width.

22. A base station antenna array comprising:

a ground plane; and an array of generally flat antennas disposed above the ground plane, the antennas each comprising a progression of series-connected radiating elements whose length, spacing and width increases in a direction away from the ground plane.

23. The apparatus defined by claim 22 wherein said elements collectively have the shape of a fan whose apex is closest to said ground plane.

24. The apparatus defined by claim 23 wherein the sides of the fan are curved.

25. The apparatus defined by claim 22 wherein said elements are end-connected by overlapping opposing ends of the elements.

26. The apparatus defined by claim 22 wherein said antennas are generally planar.

27. The apparatus defined by claim 26 wherein said antennas are arranged in a line or staggered and have the plane of each antenna parallel to, orthogonal to, or oriented at 45 degrees to a longitudinal axis of the array.

28. The apparatus defined by claim 22 wherein said antennas are arranged in groups of two.

29. The apparatus defined by claim 28 wherein said antennas are arranged and driven as dipoles.

30. The apparatus defined by claim 22 wherein said antennas are arranged in groups of four.

31. The apparatus defined by claim 30 wherein said antennas are arranged in a box geometry.

32. The apparatus defined by claim 31 wherein said antennas defining said box geometry are oriented either parallel or orthogonal to a longitudinal axis of the antenna.

33. The apparatus defined by claim 31 wherein said antennas defining said box geometry are each oriented at 45 degrees to a longitudinal axis of the antenna.

34. The apparatus defined by claim 22 wherein said radiating elements have a log perodic configuration.

35. The apparatus defined by claim 22 wherein said radiating elements comprise conductors of progressively increasing width in a direction away from said ground plane.

36. The apparatus defined by claim 22 wherein said radiating elements have an average spacing which increases progressively in a direction away from said ground plane.

37. The apparatus defined by claim 22 wherein said antennas comprise an insulative substrate, and wherein said radiating elements comprise conductive deposits on said substrate.

38. The apparatus defined by claim 22 wherein said elements have a zig-zag configuration, and wherein the ends of connected elements overlap to alter end effects associated with the elements.

39. The apparatus defined by claim 22 wherein the length of said elements increases substantially linearly.

40. The apparatus defined by claim 22 wherein the length of said elements increases non-linearly.

41. The apparatus defined by claim 22 wherein the radiating elements are substantially parallel.

42. A base station antenna array comprising:

a ground plane;

a parallel array of generally flat antennas above the ground plane, the antennas each having a progression of series-connected radiating elements whose length, spacing and width increases in a direction away from the ground plane; and a feed connected to the elements at a point nearest to the ground plane.

43. A base station antenna array comprising:

a ground plane; and a spaced array of generally flat antennas disposed above the ground plane, the antennas each having conductors configured as a diverging sinuous or zig-zag progression of end-connected elements, said diverging progression increasing in conductor length, conductor spacing and conductor width from a ground plane end to a distal end.

44. A base station antenna array comprising:

a ground plane; and an array of generally flat antennas above the ground plane, the antennas each having a diverging progression radiating elements configured as a folded linear spiral, said diverging progression increasing in radiating element length, element spacing and element width from the ground plane end to a distal end.

45. A base station antenna array comprising:

a ground plane; and an array of generally flat antennas above the ground plane, the antennas each have a helical spiral conductor with the apex of the spiral closest to the ground plane, said helical spiral having a diverging element length, element spacing and element width from the ground plane to a distal end.

46. For use in a base station antenna array, a generally flat antenna comprising a progression of radiating elements whose length increases in a direction away from a feed connection where at least some of the radiating elements of the progression of elements are connected on a first end to another element of the progression closer to the feed connection and on a second, opposing end to an element of the progression further from the feed connection and wherein said elements are end-connected by overlapping opposing ends of said elements.

47. The apparatus defined by claim 46 wherein said elements collectively have the shape of a fan whose apex is closest to said feed connection.

48. The apparatus defined by claim 47 wherein the sides of the fan are straight.

49. The apparatus defined by claim 47 wherein the sides of the fan are curved.

50. The apparatus defined by claim 46 wherein said antenna is generally planar.

51. The apparatus defined by claim 46 wherein said elements collectively define a conical configuration.

52. The apparatus defined by claim 46 wherein said radiating elements have a log periodic configuration.

53. The apparatus defined by claim 46 wherein said radiating elements comprise conductors of progressively increasing width in a direction away from said feed connection.

54. The apparatus defined by claim 46 wherein said radiating elements have an average spacing which increases progressively in a direction away from said feed connection.

55. The apparatus defined by claim 46 wherein said antenna comprises an insulative substrate, and wherein said radiating elements comprise conductive material on said substrate.

56. The apparatus defined by claim 46 wherein said elements have a zig-zag configuration, and wherein the ends of connected elements overlap to alter end effects associated with the elements.

57. The apparatus defined by claim 46 wherein the length of said elements increases substantially linearly.

58. The apparatus defined by claim 46 wherein the length of said elements increases non-linearly.

59. The apparatus defined by claim 46 wherein the radiating elements are substantially parallel.

* * * * *